US005845714A

United States Patent [19]

Sundholm

[11] Patent Number: 5,845,714

[45] Date of Patent: Dec. 8, 1998

[54] METHOD AND INSTALLATION FOR FIRE EXTINGUISHING USING A COMBINATION OF LIQUID FOG AND A NON-COMBUSTIBLE GAS

[76] Inventor: Göran Sundholm, Ilmari Kiannon kuja 3, FIN-04310 Tuusula, Finland

[21] Appl. No.: 583,102

[22] PCT Filed: Jul. 7, 1994

[86] PCT No.: PCT/FI94/00317

§ 371 Date: Jan. 16, 1996

§ 102(e) Date: Jan. 16, 1996

[87] PCT Pub. No.: WO95/02433

PCT Pub. Date: Jan. 26, 1995

[30] Foreign Application Priority Data

Jul. 16, 1993 [FI] Finland ..... 933256

[51] Int. Cl.[6] ..... A62C 3/00

[52] U.S. Cl. ..... 169/46; 169/9; 169/11; 169/16

[58] Field of Search ..... 169/46, 9, 11, 169/16

[56] References Cited

U.S. PATENT DOCUMENTS

| | | | |
|---|---|---|---|
| 2,097,908 | 11/1937 | Allen | 169/11 |
| 2,341,437 | 2/1944 | Getz | 169/2 |
| 3,548,949 | 12/1970 | Groves et al. | 169/9 |
| 4,311,198 | 1/1982 | Vasquez | 169/11 |

FOREIGN PATENT DOCUMENTS

| | | | |
|---|---|---|---|
| 694490 | 12/1930 | France | 169/9 |
| 814359 | 3/1981 | U.S.S.R. | 169/9 |
| 1639664 A | 4/1991 | U.S.S.R. | 169/9 |

*Primary Examiner*—Gary C. Hoge
*Attorney, Agent, or Firm*—Ladas & Parry

[57] ABSTRACT

A method for fighting a fire sprays a liquid fog in a total action space (1; 21) about the fire by means of at least one spray head and sprays a non-combustible gas within a partial space (3; 3*a*; 23) which is within and small in relation to the volume of the total action space (1; 21). The non-combustible gas is used, in addition, as propellent gas for at least one hydraulic accumulator (10; 14; 30) for spraying of the liquid fog. The spraying of the non-combustible gas is initiated at least essentially simultaneously with the spraying of the liquid fog.

12 Claims, 9 Drawing Sheets

METHOD AND INSTALLATION FOR FIRE EXTINGUISHING USING A COMBINATION OF LIQUID FOG AND A NON-COMBUSTIBLE GAS

The present invention relates to a method and an installation for fighting fire, in particular for spaces involving risk for fire under a floor structure or in cabinets for electrical apparatuses, and which comprises at least one spray head or sprinkler for spraying a liquid fog.

Spaces in question are e.g. computer rooms with cable channels running under the floor and possibly communicating with different kinds of apparatus cabinets, or ship engine rooms with objects liable to catch fire under the floor in the so-called bilge space.

A serious problem with such spaces is that cable channels, apparatus cabinets etc. are narrow in general and, in addition, have cables, frameworks, pipes etc., whereby difficultly accessible corners are formed. It is very difficult to position spray heads or sprinklers in such a way that the liquid fog has access to all corners; an unproportionally large number of spray heads is required, resulting in an expensive installation, and because of the general narrowness the liquid fog does not come into its own but turns into large water drops which just run down the structures.

It is the object of the invention to provide a new method and a new installation for fighting fire, in order to solve the above problems.

According to the method of the invention, a liquid fog is sprayed in the major part of the space, which major part can be considered as a normal room, while a non-combustible gas, preferably heavier than air, is sprayed into the narrow partial spaces for cables etc. The gas in question can preferably be argon gas, but a suitable mixture of argon gas and nitrogen gas can also be contemplated, or in some cases even nitrogen gas only which is lighter than air. In principle, any gas having some kind of extinguishing effect can be utilized.

The gas is well capable of penetrating into and filling up all narrow spaces and thereby smothering occurring fires. Because those spaces into which gas is sprayed are of small volume in relation to the so-called normal room, into which a liquid fog is sprayed, it is avoided that the total concentration of gas rises to non-allowed high values which may present health hazard. If, e.g. in a telephone central office, argon in combination with a liquid fog is used, the gas is only about 5 % of the total volume, whereat the oxygen content in the room decreases from about 20 % to about 19 %, which is quite harmless.

If argon gas is used as extinguishing gas, the gas collects into a layer down in the space, the gas thus well remaining under the floor and in apparatus cabinets and the like. If, in a room with gas at the floor level, a spray or jet of liquid fog is sprayed down to the floor, the gas is pushed away towards the walls and the corners of the room and is pushed upwards, in particular along the corners right up to upper corner parts of the room whereto the liquid fog has certain difficulties to reach by itself. The liquid fog hereby also tends to push the gas into cabinets standing on the floor and into similar structures into which the liquid fog does not penetrate very easily. The concentration of e.g. argon gas can be chosen to about 10 % of the total volume, lowering the oxygen content from about 20 % to about 18 %, likewise quite harmless. An approximate general rule is that the concentration of argon gas, in order to achieve extinguishing by pushing away (replacing) air oxygen, shall within the partial space in question be 40–50 % of the volume. With this as a basis, the partial space in question may well be about 30 % of the total volume of the action space, whereat the hazard limit applied for a human being, 15 % oxygen of the total volume, is cleared with a safe margin.

Cable fires often generate PVC smoke gases which damage e.g. computer apparatuses. In e.g. computer rooms, the combination of extinguishing gas and liquid fog spray, according to the invention, which creates a suction along the ceiling of the room inwards to the liquid fog spray, has the effect that the gas pushes the smoke gases, including harmful PVC gases, up towards the ceiling, whereafter the smoke gases are sucked into the fog and on one hand are washed and cooled and on the other hand are sprayed to floor level, so that computers and other sensitive apparatuses at least essentially avoid damages. The liquid fog also has a good general cooling effect.

The use of gases like halon and carbon dioxide for fire extinguishing purposes has as such been known for a long time but it has been what can be called a total use. Different from such a total use, the present invention is directed to, in relation to the total action space volume involved in each case, a local and controlled concentration of gas to certain partial spaces or partial areas, in combination with a liquid fog for the rest of the space. The use of halon will apparently cease within a near future. Replacing gases are under development but are so far unproportionally expensive. The present invention, which makes it possible to manage with small amounts of gas, can make a use of even expensive gases economically worth contemplating. Already existing installations intended for halon can, for the part of the relevant partial spaces involved in the present invention, be used with minor modifications only. In general there may be a need to add pressure reducing valves at suitable places, because installations according to the invention preferably employ a higher operating pressure than what existing halon installations do.

Thanks to the fact that one can manage with small amounts of gas, it is further possible to, if so desired, use carbon dioxide in such cases where carbon dioxide hereto has meant a serious health hazard; the carbon dioxide content must not exceed 5 volume % in occupied rooms.

The invention shall in the following be described in more detail, with reference to preferable exemplifying embodiments shown in the attached drawing.

FIGS. 1–5 show different embodiments in connection with a computer room or similar.

FIG. 6 shows a first embodiment in connection with a ship engine room or the like.

FIG. 10 shows a second embodiment in connection with a ship engine room or the like.

FIGS. 22–24 show such an application of the spray head of FIGS. 11–14 that preferably can be mounted in the floor of a car deck in a ship, or another space comparable to that.

Figure 1:
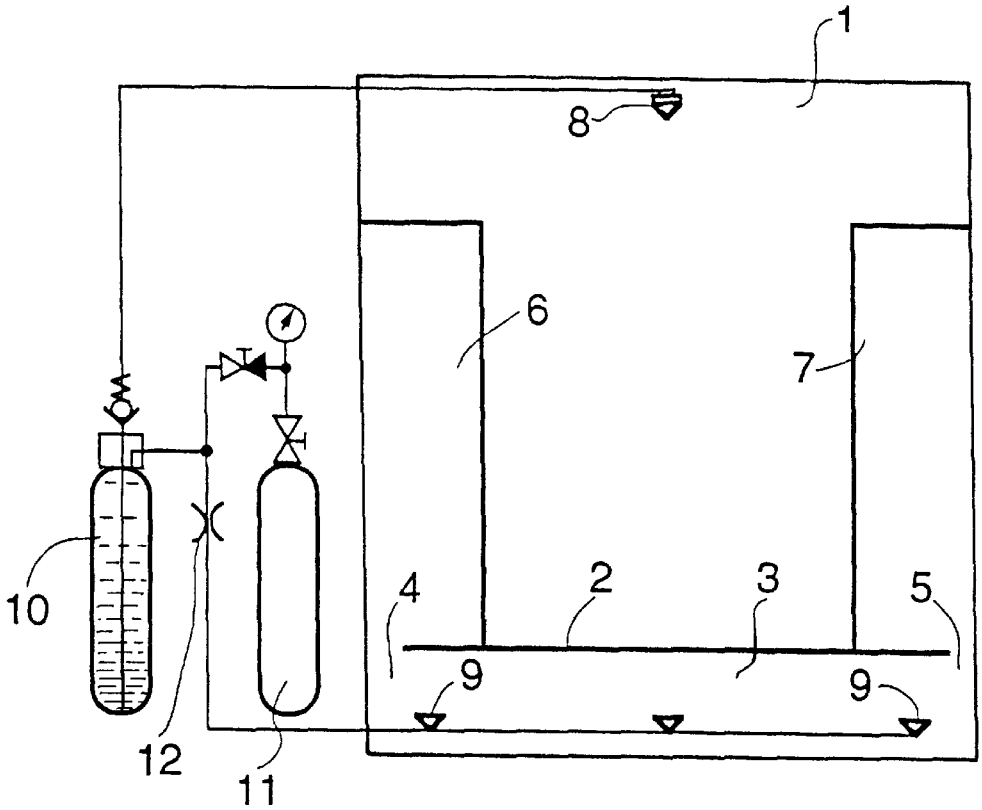

In FIGS. 1–4 the reference numeral 1 indicates a computer room the floor of which is indicated by 2. Under the floor is a cable channel 3 which via openings 4 and 5 in the floor communicates with apparatus cabinets 6 and 7. At the ceiling of the room 1 are positioned a suitable number of spray heads or sprinklers 8 and in the cable channel 3 are arranged a number of gas nozzles 9.

Figure 2:
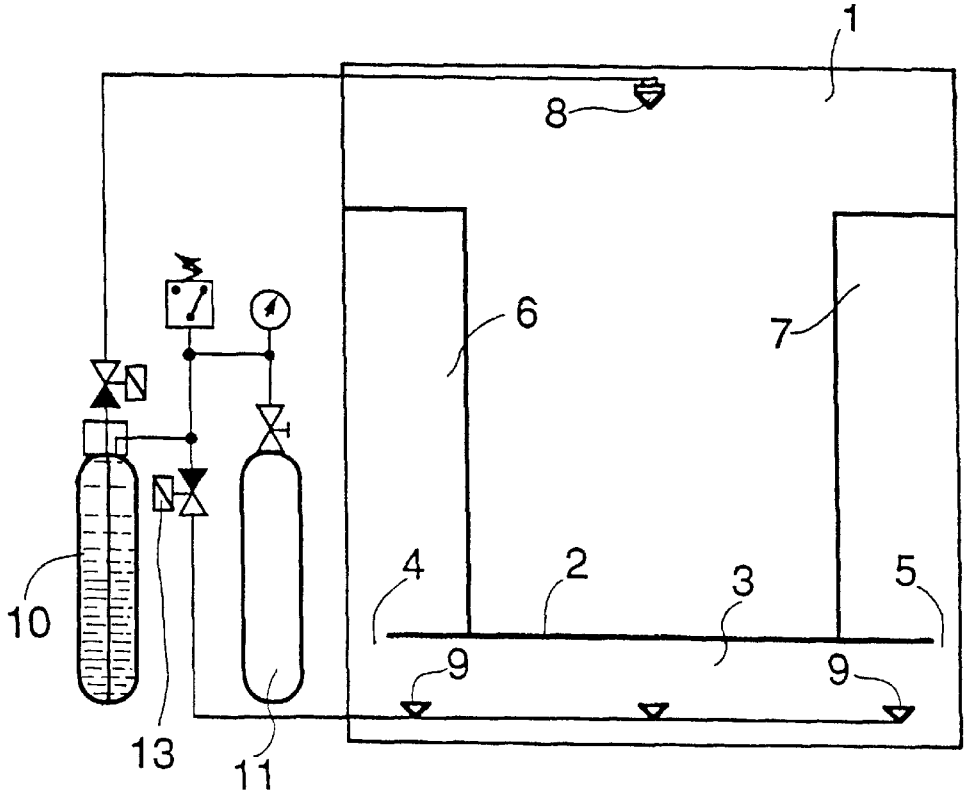

Liquid is delivered to the spray heads 8 from one or a plurality of hydraulic accumulators, in FIGS. 1 and 2 a liquid container 10, a so-called pressure water bottle, wherefrom the liquid is driven out by means of drive gas, e.g. argon, from a high pressure gas container 11.

In FIG. 1 a part of the drive gas is already from the start lead to the gas nozzles 9 via a throttle 12, in FIG. 2 delivery of gas to the nozzles 9 takes place via an e.g. electrically operated valve 13 which can be arranged to open when the pressure in the container 11 has fallen to a predetermined value.

Figure 3:
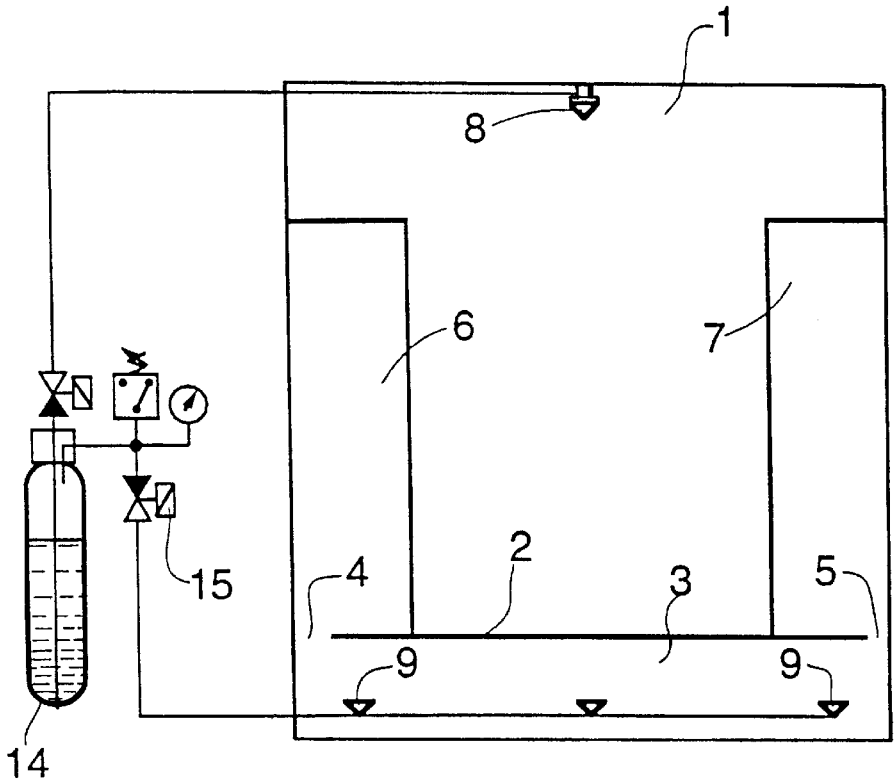
Figure 4:
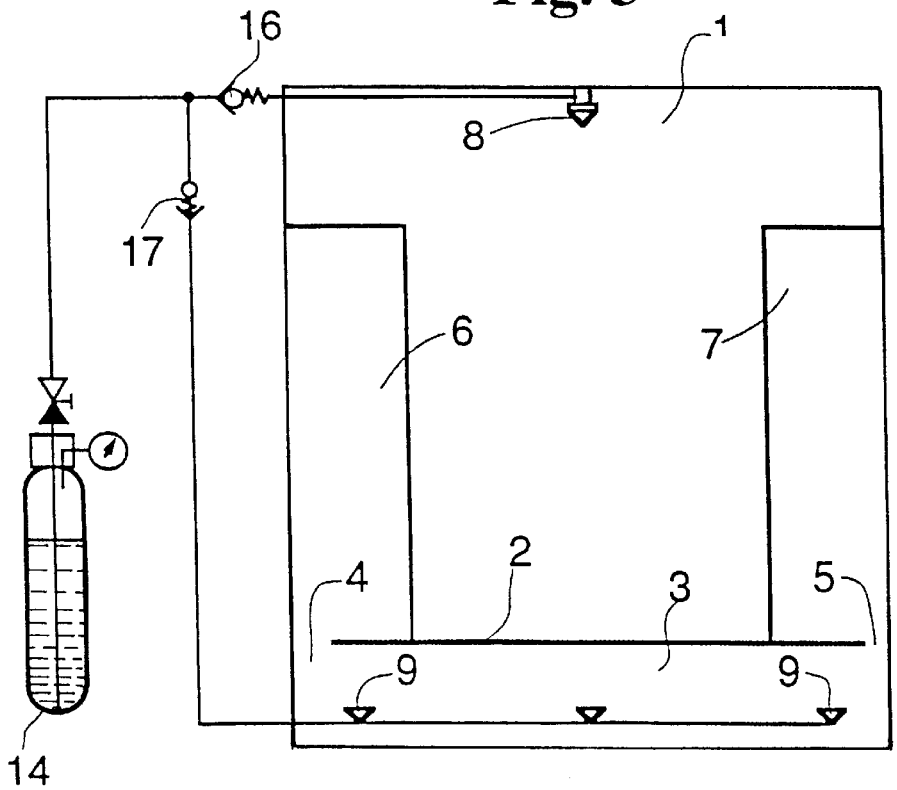

In FIGS. 3 and 4 the drive gas is compressed in the upper part of a hydraulic accumulator 14. In FIG. 3 drive gas is delivered to the nozzles 9 in principle in the same way as in FIG. 2 via an e.g. electrically operated valve 15, and in FIG. 4 drive gas is delivered to the nozzles 9 by utilizing a combination of valves 16 and 17 adapted in such a way that when the bottle 14 has been emptied of liquid and the pressure of the drive gas after expansion has fallen to a predeterminable value, the valve 16 in the liquid line to the spray head 8 closes while the valve 17 in a branch line to the gas nozzles 9 opens. The embodiment of FIG. 4 has the advantage that the desired operation can be achieved without access to electric current. A preferable embodiment of the valve 17 shall later be described in more detail with reference to FIGS. 7–9.

Figure 5:
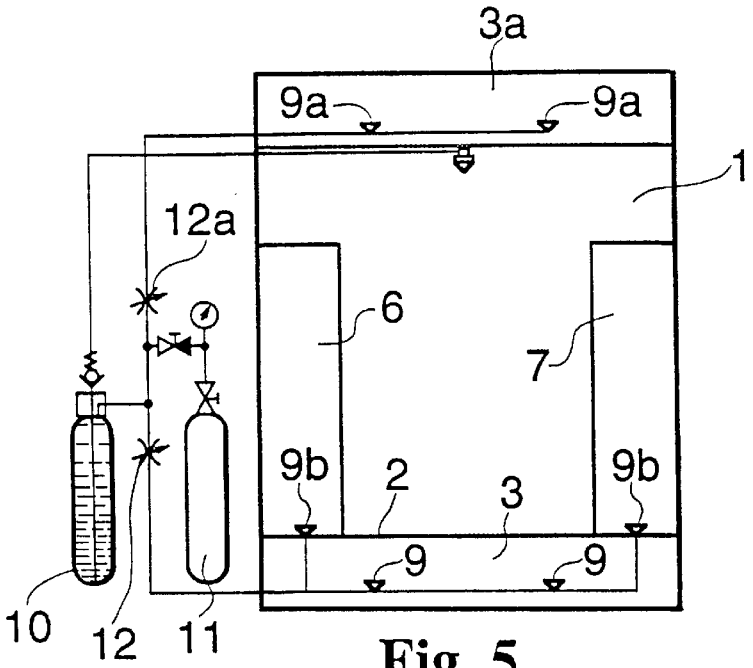

The embodiment of FIG. 5 works in principle in the same way as the embodiment of FIG. 1. In FIG. 5 the computer room 1 or the like has, in addition to a cable channel 3 under the floor 2, also an upper cable channel 3*a* above the ceiling of the room, with gas nozzles 9*a*. Gas nozzles 9*b* are arranged to open directly into the apparatus cabinets 6 and 7. Delivery of drive gas to the nozzles 9*a* takes place in the same way as to the nozzles 9 and 9*b*, via a throttle 12*a*.

In case the room 1 would not have any cable channels or similar spaces liable to catch fire under the floor but still apparatus cabinets liable to catch fire, the embodiment of FIG. 5 can be modified to settle for gas nozzles directed into the cabinets, possibly from above instead of from below as in FIG. 5. The liquid fog sprayed down from the ceiling level participactes considerably in keeping the gas in the cabinets.

Figure 6:
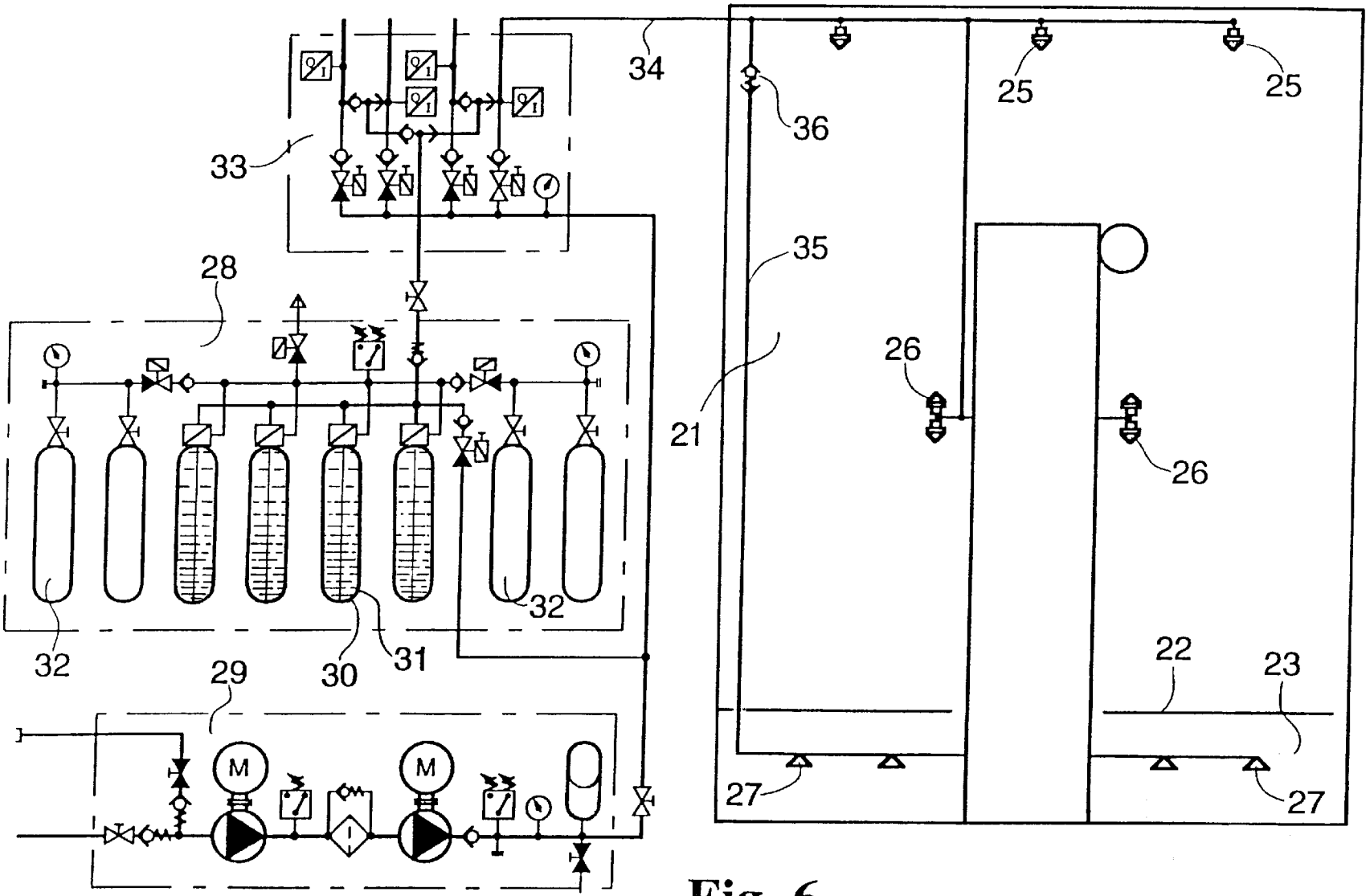

In FIG. 6 a ship engine room is indicated by 21, the floor of the engine room is indicated by 22 and the bilge space under the floor is indicated by 23. An engine, e.g. a diesel engine, is indicated by 24. At the ceiling of the engine room are positioned a number of spray heads or sprinklers 25 and close to the engine 24 additionally a number of spray heads or sprinklers 26. In the bilge space 23 are positioned a number of gas nozzles 27.

The fire fighting installation of FIG. 6 comprises a high pressure drive unit 28 and a low pressure drive unit 29. The high pressure unit 28 includes a number of liquid bottles 30, the walls of the out-going rising tubes 31 of which preferably have a number of apertures at different levels, as shown e.g. in the Finnish patent application 924752, for successively mixing of drive gas into the out-going liquid, and drive gas bottles 32 which are arranged in two groups or batteries indicated by A and B. Out-going liquid is directed to the relevant fire zone, in FIG. 6 to the fire zone D, by means of a valve 33 which preferably is made as presented in the Finnish patent application 925836.

The installation works in the following way.

To begin with, the liquid bottles 30 are emptied a first time by means of one drive gas battery, e.g. the battery A. When the bottles 30 and 32 are empty the low pressure unit 29 is switched in, to on one hand fill the bottles 30 again with liquid and on the other hand feed liquid to the spray heads 25 and 26, primarily for the purpose of cooling. When the bottles 30 are full again they can be emptied a second time by means of the second drive gas battery B. In this way the capacity of the liquid bottles can be doubled.

To the out-going liquid line 34 is joined a branch 35 which leads to the gas nozzles 27. In the line 35 is mounted a valve 36 of such construction that it is closed at line pressures less than e.g. 20 bar and more than e.g. 100 bar but is open within the pressure interval 20–100 bar. The drive gas bottles 32 are hereby adapted in such a way that they after completed emptying of the liquid bottles 30 have a gas pressure somewhat less than 100 bar; the gas of the bottles 32 are delivered to the gas nozzles 27.

The drive unit shown in FIG. 6 can of course also well be used in such fire fighting installations where a liquid fog only is sprayed, i.e. without gas nozzles 27 and gas line 35 with valve 36.

Figure 7:
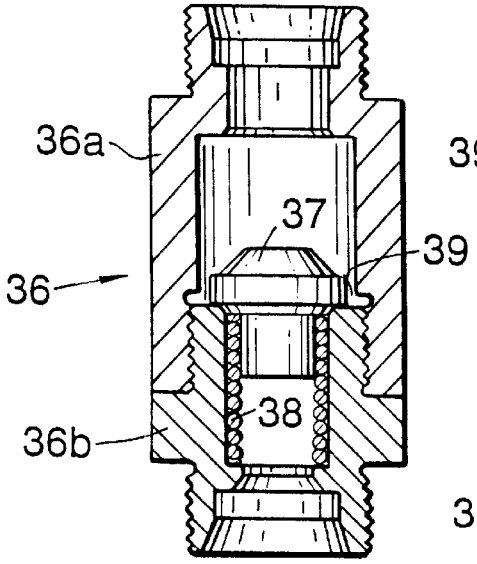
FIGS. 7–9 show a valve preferable for use in the embodiments of FIGS. 4 and 6.
Figure 8:
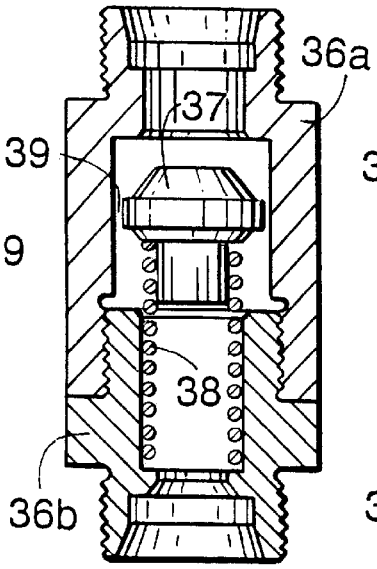
Figure 9:
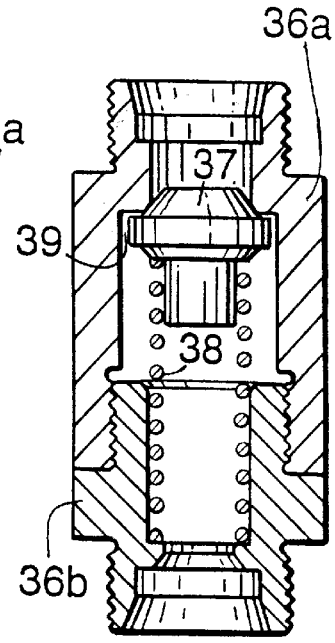

A preferred structure of the valve 36 is shown in FIGS. 7–9. Inside the valve housing 36*a*, 36*b* is positioned a valve head 37 movable between a first position in closing abutment, pushed upon by a spring 38, against an opening in one valve housing part 36*a*, as shown in FIG. 9, and a second position in closing abutment, with the spring 38 compressed, against an opening in the other valve housing part 36*b*, as shown in FIG. 7. The spring 38 can without difficulty, as desirable in each case, be adapted e.g. in such a way that it holds the valve head 37 in the position of FIG. 9 against a pressure up to about 20 bar and at a pressure of about 100 bar yields so, thanks to the liquid pressure fall in an annular passage 39, adapted for this purpose, between the valve head 37 and the valve housing part 36*a*, that the valve head takes the position of FIG. 7. In both cases the valve 36 is closed. Within the pressure interval 20–100 bar the spring 38 yields partly only, as shown in FIG. 8, the valve being open for gas to flow to the gas nozzles 27, as earlier mentioned. The pressure fall for gas in the passage 39 is considerably smaller than for liquid at the same pressure. In this way it can be avoided that high pressure liquid and liquid delivered by the low pressure unit 29 go to the gas nozzles. As earlier mentioned, a similar valve structure can likewise be used in the embodiment of FIG. 4, the valve 17.

Figure 10:
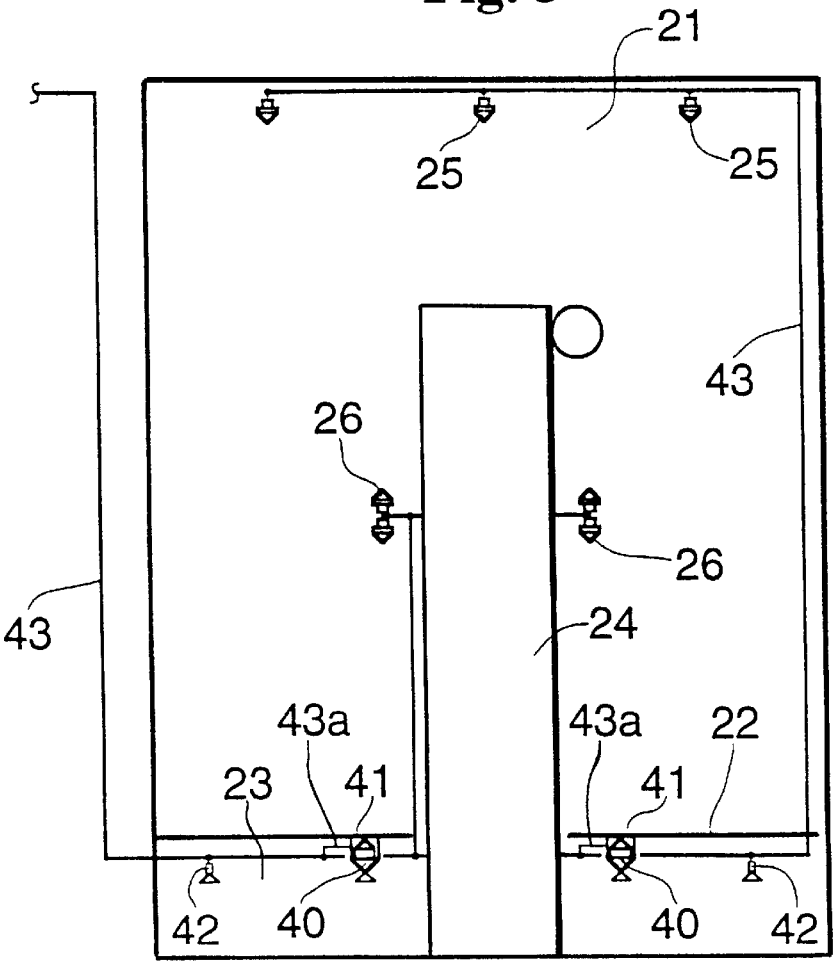

A second preferred embodiment for engine rooms and the like is shown in FIG. 10. The drive unit of the installation is in FIG. 10 similar to the one in FIG. 6, while the arrangement in the engine room 21 itself is somewhat different.

Sprinklers or spray heads 25 positioned at the ceiling of the engine room can be similar to those in FIG. 6, likewise spray heads 26 near the engine 24. In the floor 22 of the engine room are, in addition, mounted a number of spray heads 40, preferably near to the engine 24. The spray heads 40 are arranged to upon activation rise a distance above the floor 22, while pushing off a cover 41, essentially as is presented in the international patent application PCT/FI92/00213, and in a first stage produce a liquid fog spray or jet directed upwards and producing a strong suction out and up from the bilge space 23, and in a later stage spray a gas into the bilge space, generally applying that principle solution which is shown in FIGS. 7–9. In order to secure a sufficient amount of gas in the bilge space 23 the spray heads 40 can be complemented by a number of gas nozzles 42 which likewise apply the valve solution of FIGS. 7–9. All sprinklers and spray heads as well as gas nozzles can thereby be fed by one and the same line 43 going out from the drive unit of the installation. The way of operation of the floor spray heads 40, which are essential in the embodiment of FIG. 10, shall in the following be described with reference to FIGS. 11–14.

Figure 11:
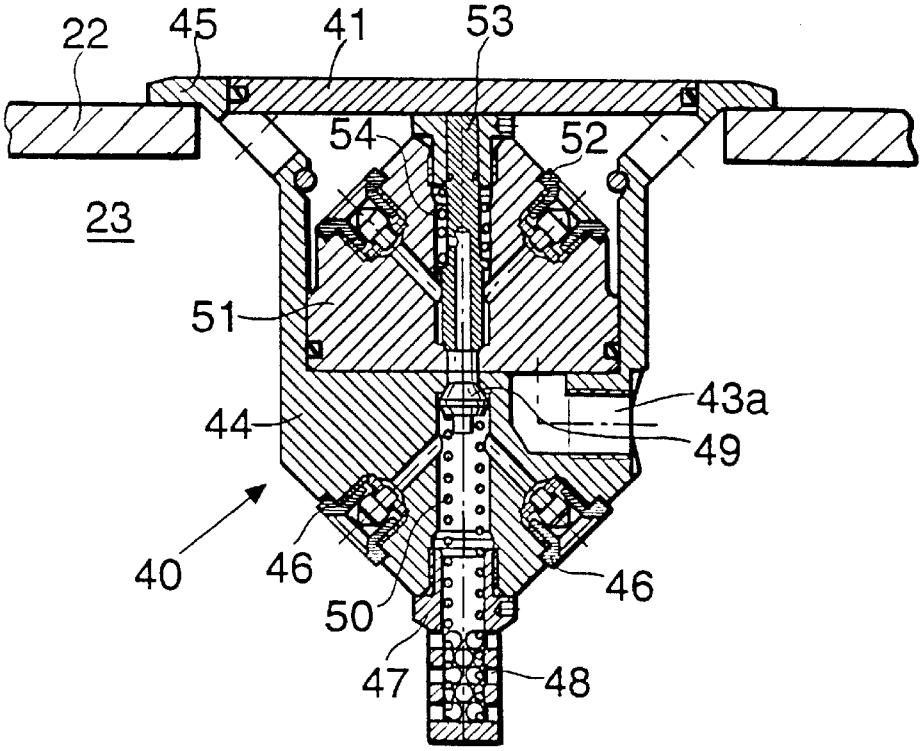
FIGS. 11–14 show a preferable embodiment of a spray head mountable in the floor of an engine room.
Figure 12:
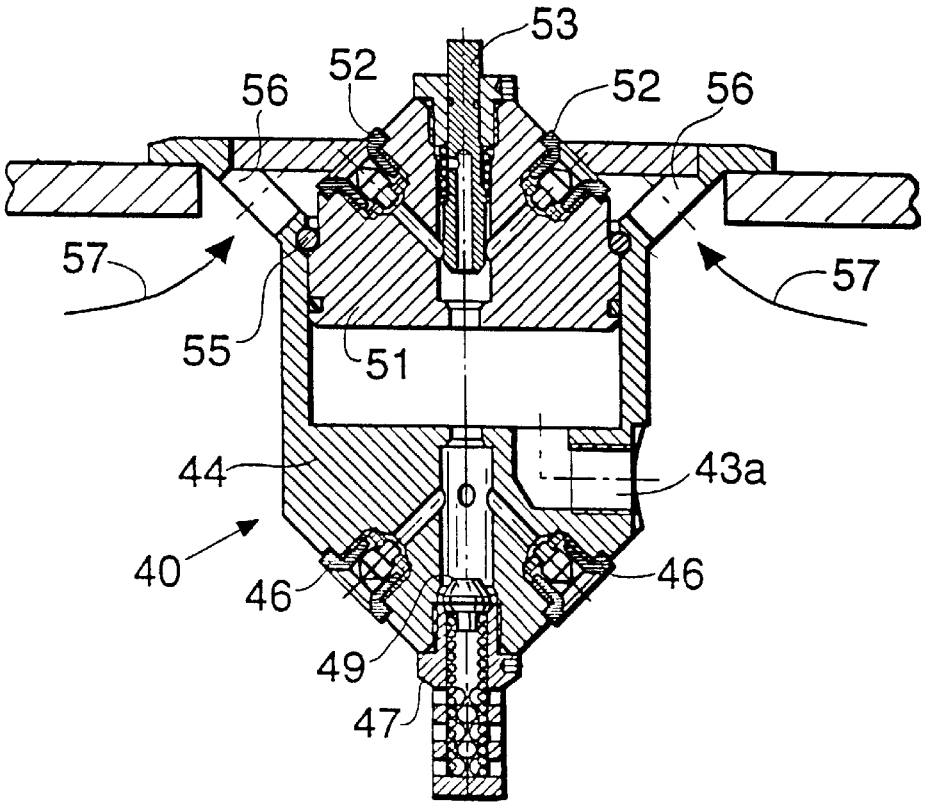
Figure 13:
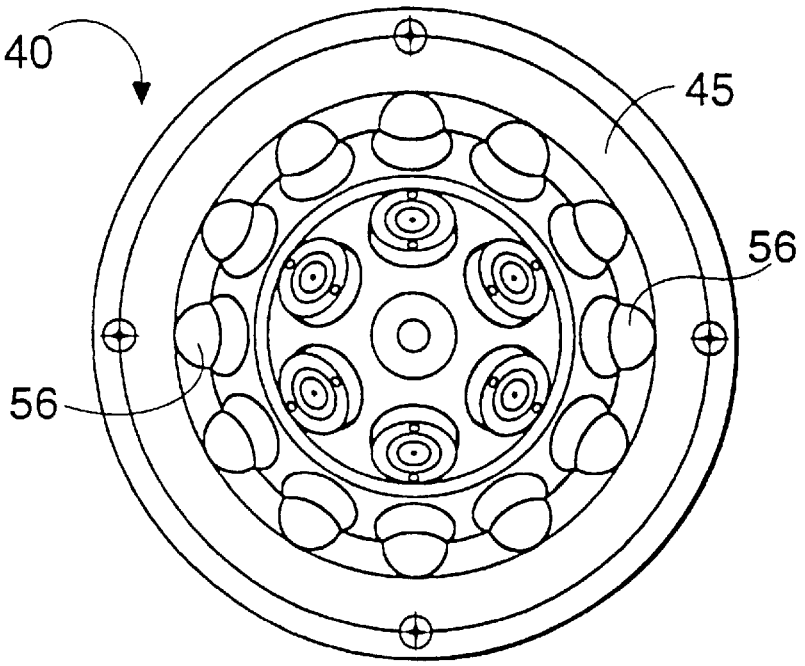
Figure 14:
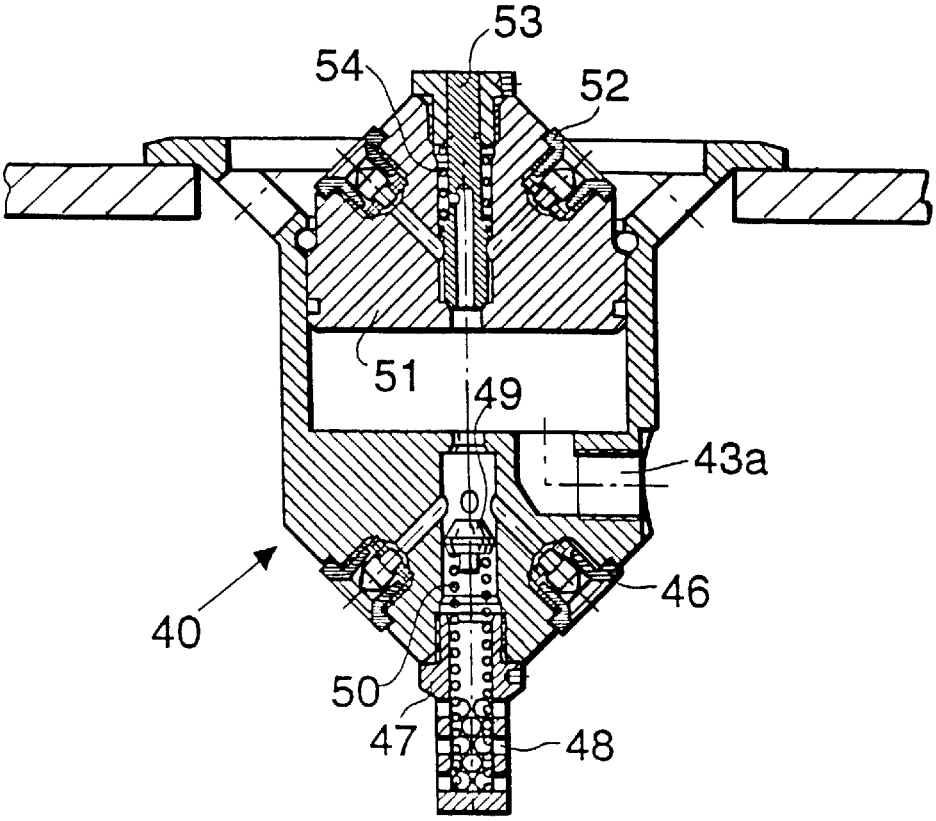

FIG. 11 shows a spray head 40 in stand-by state, FIGS. 12 and 13 show the spray head in said first activated stage producing a liquid fog, and FIG. 14 shows said later activated stage spraying gas into the bilge space.

The spray head 40 comprises a primary housing or holder 44 which is firmly fastened to the floor 22 of the engine room by means of a flange 45. The primary housing 44 has an inlet 43*a* for liquid and gas, respectively, and in its lower portion a number of liquid nozzles 46 directed obliquely to the sides and a central gas nozzle 47 with orifices 48 preferably directed to the sides. The connection from the inlet 43*a* to the nozzles 46 and 47 is regulated by means of a valve head 49 being under the action of a spring 50, in principle in the same way as in the valve according to FIGS. 7–9.

In the upper portion of the primary housing 44 is slideably arranged a secondary housing 51 with a number of liquid spray nozzles 52 directed obliquely upwards to the sides. The connection from the inlet 43*a* to the spray nozzles 52 is regulated by means of a spindle 53 which a spring 54 tries to push to the end position closing the connection, as shown in FIG. 11. The spring 54 is positioned in an annular space betweeen the housing 51 and the spindle 53, which annular space, via a central channel formed in the spindle, communicates with the the inlet. By dimensioning said annular space suitably, the pressure in the inlet can be partly balanced e.g. in such a way that even a relatively weak spring 54 is capable of keeping the spindle in the closed position according to FIG. 11 against a pressure of e.g. up to 100 bar.

When the installation is activated after a fire has started, liquid is delivered to the spray head 40 with a pressure higher than 100 bar, e.g. 280 bar, which state is shown in FIGS. 12 and 13. The secondary housing 51 has been lifted up with a great force to upper end position against a retainer ring 55 and has thereby pushed off the cover 41. The high pressure has also driven up the spindle 53, the upper protruding end of which secures that the cover does not remain lying in front of the nozzles 52 which now are in communication with the inlet 43*a*. The nozzles 52 produce a forceful upward liquid fog spray or jet which in turn produces a forceful suction out and up from the bilge space via frame apertures 56 adjacent the flange 45, said suction being indicated by arrows 57. As an example can be mentioned that a liquid fog spray of about 5 liters liquid per minute sucks along up to 5000 liters of smoke gases and air. The bilge space is in practice a sea of fire with remarkable flames being sucked out of the frame apertures 56. These flames, together with the also otherwise hot smoke gases, bring about a very powerful generation of steam in the sprayed liquid fog already almost immediately at floor level. The steam participates very effectively in extinguishing the fire.

At the same time the high pressure in the inlet 43*a* has hit the valve head 49 down against the gas nozzle 47, so that the connetcion thereto is closed while liquid can be sprayed out of the nozzles 46.

After the liquid bottles 30 have been emptied and the pressure of the drive gas in the bottles 32 has fallen somewhat below 100 bar, the spray head 40 takes a position in principle according to FIG. 14. The secondary housing 51 is still in raised position but the spindle 53 has been pressed back by the spring 54, so that the connection from the inlet 43*a* to the nozzles 52 again is closed. The spring 50 has lifted the valve head 49 off the gas nozzle 47 which now communicates with the inlet 43*a*. Most of the gas flows out through the orifices 48 of the nozzle 47, a small part of the gas flows out through the nozzles 46. This state continues until the gas pressure has fallen so low, e.g. to 20 bar, that the spring 50 presses the valve head 49 back to the position of FIG. 11. The powerful generation of steam during the stage according to FIGS. 12 and 13 is in many cases alone sufficient for extinguishing a fire definitively, but a final fighting with gas is still recommendable as a safety measure.

Figure 15:
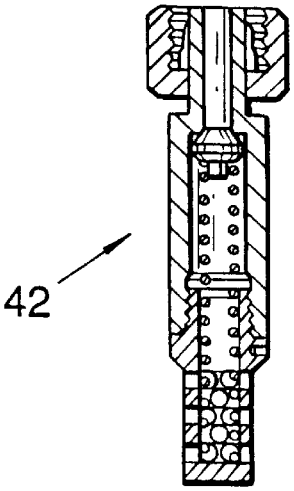
FIGS. 15–17 show a preferable embodiment of a gas nozzle mountable under the floor of an engine room.
Figure 16:
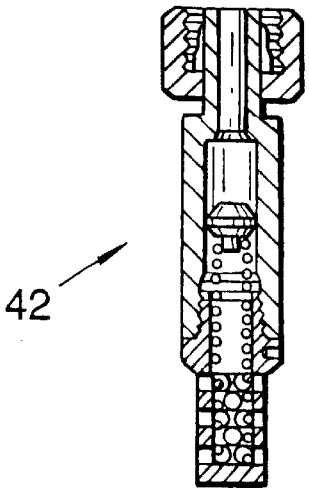
Figure 17:
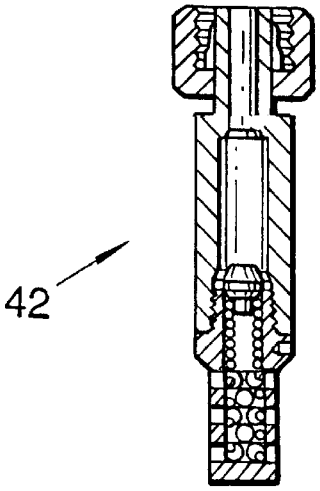

The same principle solution described above can well be applied also to the complementary gas nozzles 42, FIG. 15 shows such a nozzle when the pressure is less than 20 bar, FIG. 16 shows the state of the nozzle within the pressure interval 20–100 bar, and FIG. 17 shows the state of the nozzle when the pressure is over 100 bar.

With floor spray heads and gas nozzles made according to FIGS. 11–17, and preferably with apertures in the wall of the riser tubes 31 of the liquid bottles 30, is achieved what could be called optimal utilization of the drive gas without wasteful spending of liquid delivered by the low pressure drive unit 29 of the installation.

With respect to the spray heads 25 and 26 positioned at the ceiling and near the engine, the situation is different, i.e. they shall rather be open at a pressure over 100 bar and below 20 bar but be closed within the pressure interval 20–100 bar. A preferred structure for this purpose is shown in FIGS. 18–21.

The spray head 25 has, mounted in a housing 60, a number of nozzles 61 directed obliquely downwards and a central through flow nozzle 62. The connection between the inlet 43*b* and the nozzles 61 as well as the nozzle 62 is regulated by means of a spindle structure in two co-operating parts 63 and 64 which both are acted upon by a spring 65 and 66, respectively, supported against the nozzle 62. If the spring 65 acting on the spindle part 63 is adapted to withstand a pressure of 100 bar in the inlet 43*b* and the spring 66 acting on the spindle part 64 is adapted to overcome 20 bar only, the function will be as follows.

Figure 18:
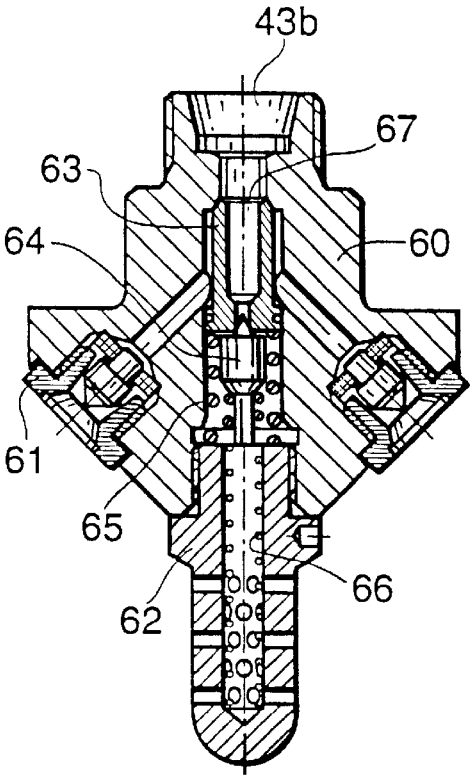
FIGS. 18–21 show a preferable embodiment of a spray head mountable at the ceiling of an engine room.

In stand-by state, according to FIG. 18, with the pressure in the inlet 43*b* being almost zero, the spindle part 63 is pressed up by the spring 65 into sealed abutment against the inlet opening and the spindle part 64 is in turn pressed by the spring 66 against the spindle part 63 and thereby closes an axial, suitably throttled channel 67 running through the spindle part 63. The connections from the inlet 43*b* to all nozzles are closed.

Figure 19:
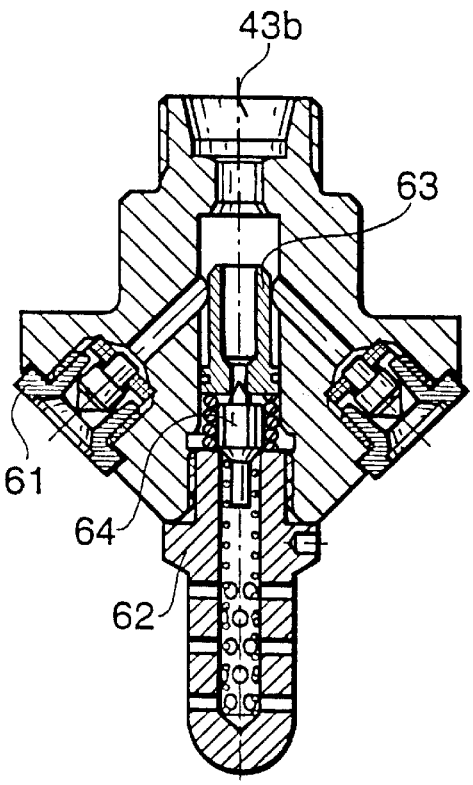

When the installation is activated, liquid with a pressure of e.g. 280 bar is connected, whereat the whole spindle structure 63, 64 is driven to the bottom with the spindle part 64 in sealed abutment against the inlet of the nozzle 62, as shown in FIG. 19. The inlet 43*b* communicates with the nozzles 61 but not with the nozzle 62.

Figure 20:
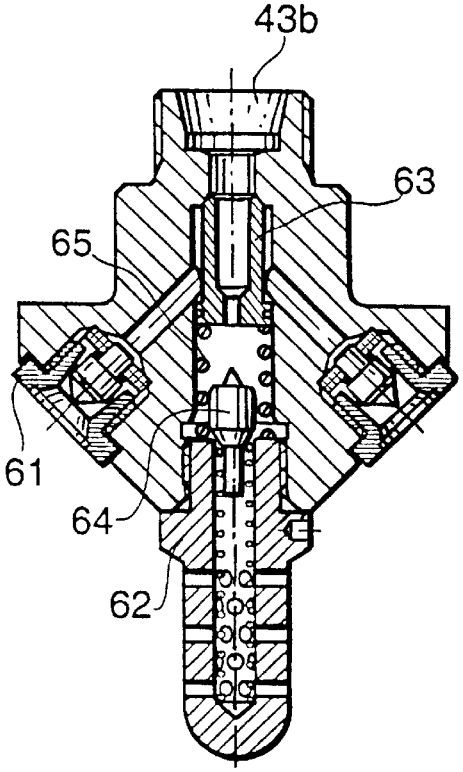

When the pressure in the inlet 43*b* has fallen below 100 bar but is greater than 20 bar, which is assumed to be the case in FIG. 20, the spring 65 pushes the spindle part 63 back to the position of FIG. 18 but the spindle part 64 is still held in the position of FIG. 19. The connections from the inlet 43*b* to all nozzles are again closed.

Figure 21:
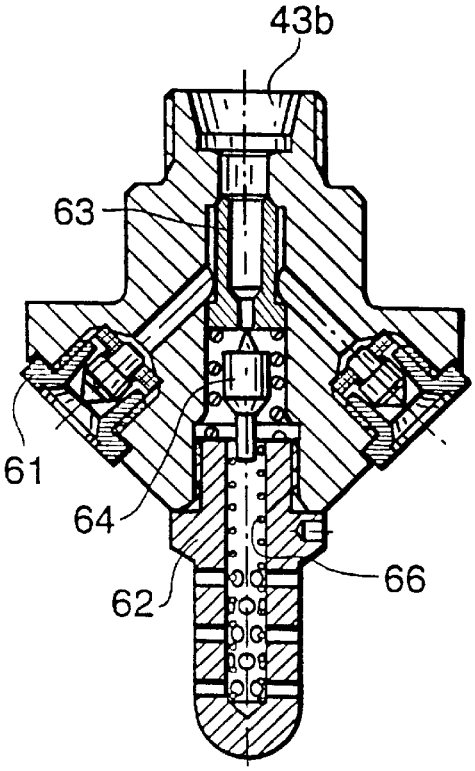

When the pressure in the inlet 43*b* falls below 20 bar, which happens when the low pressure unit 29 of the installation is connected, the spindle part 64 rises up from the position of FIG. 20 to a "floating" intermediate position according to FIG. 21, whereat the connection from the inlet 43*b* to the nozzles 61 is still closed but the connection to the nozzle 62 is open through the axial channel 67 of the spindle part 63 and past the floating spindle part 64.

Figure 22:
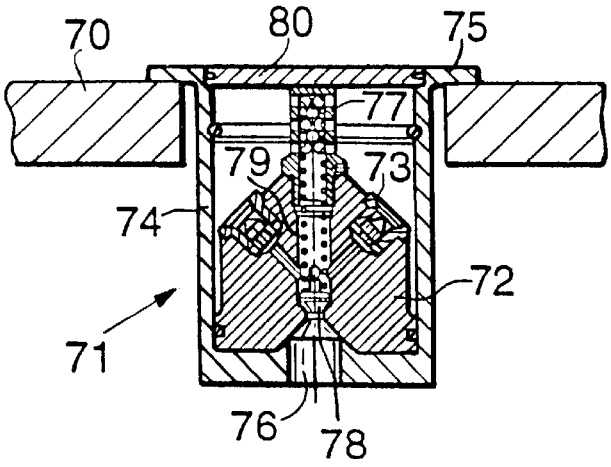
Figure 23:
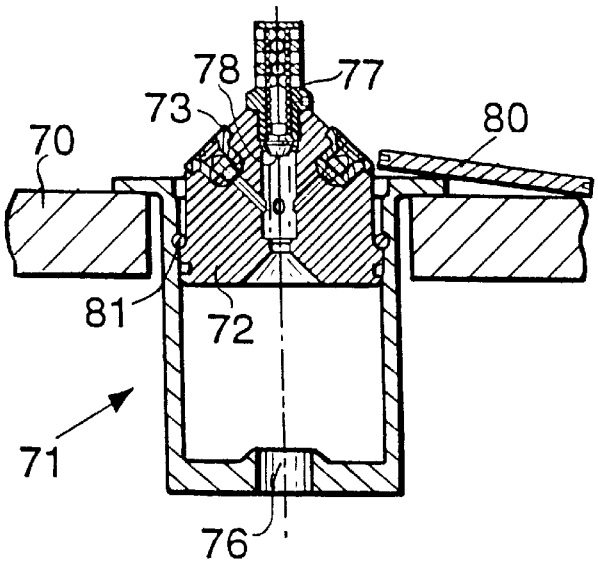
Figure 24:
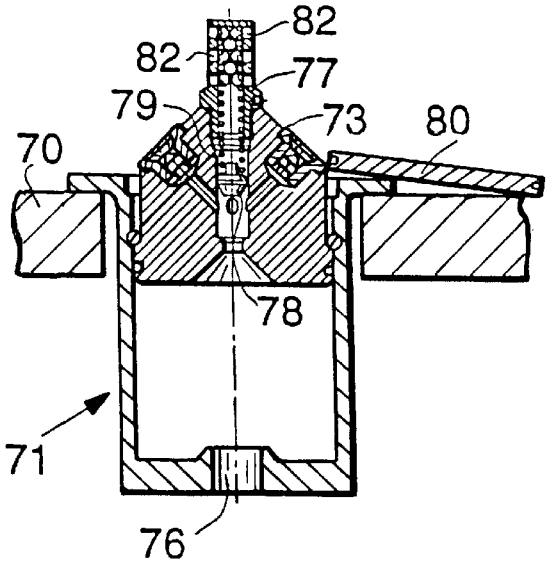

FIGS. 22–24 finally show such an application of the invention that preferably can be used in that kind of action spaces which do not comprise difficultly accessible partial spaces liable for fire under the floor but where the floor level itself generally can be assumed to constitute a particular fire risk zone. As an example can be mentioned a car deck in a ship.

A car deck floor is indicated by 70 and a spray head mounted in the floor is generally indicated by 71. The housing 72 of the spray head, with a number of nozzles 72 directed obliquely upwards to the sides, is arranged slideably in a holder 74 which is firmly fastened to the floor 70 by means of a flange 75. The connection from an inlet 76 for liquid and gas, respectively, to the nozzles 73 and to an upper central gas nozzle 77 is regulated in the same way as in FIGS. 11–14, by means of a valve head 78 which under the action of a spring 79 is held in position according to FIG. 22 closing the connection, e.g. in stand-by state with a low pressure in the inlet 76 and with a cover 80 on. The installation can be operated in the same way as shown in FIGS. 6 and 10.

In FIG. 23 the spray head has been activated by connecting liquid under high pressure, which can be nearly 300 bar, whereat the housing 72 has been lifted up to upper end position against a retainer ring 81 and the cover 80 has been pushed off by the gas nozzle 77 and has fallen to the side. The valve head 78 has by the liquid pressure been driven up against the gas nozzle 77 and closes connection thereto but has opened connection to the nozzles 73 which produce a forceful liquid fog, in the way as earlier has been described.

In FIG. 24 the drive gas pressure has fallen to a value below e.g. 100 bar, whereat the spring 79 has pushed the valve head off the position of FIG. 23, so that most of the gas available at this stage, preferably argon or another inert gas heavier than air, can flow out through the orifices 82 of the gas nozzle 77, preferably in essentially horizontal direction, and form a gas layer along the floor 70, said gas layer pushing away oxygen and thus smothering the fire.

The invention can also be applied to isolated objects or objects in a small group, e.g. a separate computer or a separate diesel engine in a larger room or hall, in such a way that the object is screened off the surrounding area by means of liquid fog, using at least one but preferably a plurality of spray heads or sprinklers positioned appropriately above and/or around the object, and gas is sprayed on, into or under the object. The liquid fog then acts as a kind of external protection while the gas acts as an internal protection.

The liquid droplets in the liquid fog can be of a size typically about 10–200 microns, far different from conventional sprinkler installations which spray extinguishing liquid comparable to rain. Sprinklers and spray heads included in the installation are preferably constructed in accordance to what is presented in the international patent applications PCT/FI92/00060 and PCT/FI92/00155. It is, however, of course also possible to apply the basic idea of the invention to low pressure operation, utilizing local, controlled concentration of gas to a partial area or a partial space of the total action space volume in each case.

I claim:

1. Method for fighting fire, comprising spraying a liquid fog in a total action space (1; 21) by means of at least one spray head, spraying within a partial space (3; 3*a*; 23) which is small in relation to the volume of the total action space (1; 21) a non-combustible gas using the non-combustible gas, in addition, as propellent gas for at least one hydraulic accumulator (10; 14; 30) for producing the liquid fog and initiating the spraying of the non-combustible gas at least essentially simultaneously with the spraying of the liquid fog.

2. Method according to claim 1, wherein a non-combustible gas heavier than air is used, in order to produce a layer of gas in the low part of the action space.

3. Method according to claim 2 used in an action space with walls and corners, further comprising spraying a liquid fog on the gas layer in order to drive the non-combustible gas sidewardly and up along the walls and up along the corners of the action space.

4. Method according to claim 2, wherein argon gas or a gas mixture with argon gas as a component is used as said non-combustible gas.

5. Method for fighting fire, comprising spraying a liquid fog in a total action space (1; 21) by means of at least one spray head, spraying within a partial space (3; 3*a*; 23) which is small in relation to the volume of the total action space (1; 21) a non-combustible gas using the non-combustible gas, in addition, as propellent gas for at least one hydraulic accumulator (10; 14; 30) for producing the liquid fog and initiating the spraying of the non-combustible gas after the propellent gas pressure, in a container (11; 32) for the purpose, has fallen to a predeterminable value.

6. Method according to claim 5, wherein initiating the spraying of the non-combustible gas after the propellent gas has emptied said at least one hydraulic accumulator (30) of liquid.

7. Installation for fighting fire, with at least one spray head (25) for producing a liquid fog in an action space (1; 21) and with a gas driven drive unit comprising propellent gas, wherein at least part of the propellent gas is arranged to be fed to gas nozzles (9; 27; 40) positioned within at least one locally restricted partial space (3; 23) of the action space (1; 21) of the installation.

8. Installation according to claim 7, wherein the drive unit comprises hydraulic accumulators (30), and the gas nozzles being arranged to be opened after the hydraulic accumulators (30) have been emptied of liquid, at a correspondingly fallen propellent gas pressure.

9. Installation according to claim 8, wherein said at least one spray head (25) is arranged to be closed at said fallen gas pressure and at a pressure of connection for the gas nozzles.

10. Installation according to claim 8, wherein the action space comprises a floor, and comprising at least one combined gas nozzle (47) and liquid fog spray head (40) mounted in the floor, the spray head being arranged to produce a powerful suction from below the floor upwards, in order to produce a powerful generation of steam in the liquid fog.

11. Method according to claim 1, wherein water is used as said liquid fog.

12. Method according to claim 5, wherein water is used as said liquid fog.

* * * * *